US005369730A

United States Patent [19]

Yajima

[11] Patent Number: 5,369,730

[45] Date of Patent: Nov. 29, 1994

[54] SPEECH SYNTHESIZER

[75] Inventor: Shunichi Yajima, Hachioji, Japan

[73] Assignee: Hitachi, Ltd., Tokyo, Japan

[21] Appl. No.: 888,208

[22] Filed: May 26, 1992

[30] Foreign Application Priority Data

Jun. 5, 1991 [JP] Japan ..... 3-134022

[51] Int. Cl.[5] ..... G10L 5/02

[52] U.S. Cl. ..... 395/2.76; 381/40

[58] Field of Search ..... 381/51, 52, 40; 395/2.76

[56] References Cited

U.S. PATENT DOCUMENTS 3,872,250 3/1975 Coolter ..... 381/39
4,058,676 11/1977 Wilkes et al. ..... 381/51
4,163,120 7/1979 Baumwolspiner ..... 395/2.78

FOREIGN PATENT DOCUMENTS 01-179000 6/1989 Japan ..... G10L 9/00

OTHER PUBLICATIONS

Oppenheim, Alan V., "Speech Analysis-Synthesis System Based on Homomorphic Filtering," The Journal of The Acoustic Society of America, vol. 45, No. 2, 1969, pp. 458–465.

Rabiner, L. R., et al. *Digital Processing of Speech Signals*, Prentice-Hall Signal Processing Series, 1983, Chapter 6, "Shore-Time Fourier Analysis," pp. 250–354, and Chapter 7, Homomorphic Speech Processing, pp. 355–395.

Stuart, Jim. "Speech Synthesis Devices and Development Systems," *Electronic Engineering*, Jan. 1990, pp. 49 and 52.

*Primary Examiner*—Allen R. MacDonald
*Assistant Examiner*—Richard J. Kim
*Attorney, Agent, or Firm*—Fay, Sharpe, Beall, Fagan, Minnich & McKee

[57] ABSTRACT

In an overlap addition unit, speech waveform data is subjected to overlap addition every period read out from a period storage unit, and in a simple addition unit, the waveform data obtained by the overlap addition and the aperiodic waveform data read out from an aperiodic waveform storage unit are added to each other. Thus, the aperiodic waveform is given to the speech waveform to improve the quality of synthesized speech.

9 Claims, 7 Drawing Sheets

FIG. IB
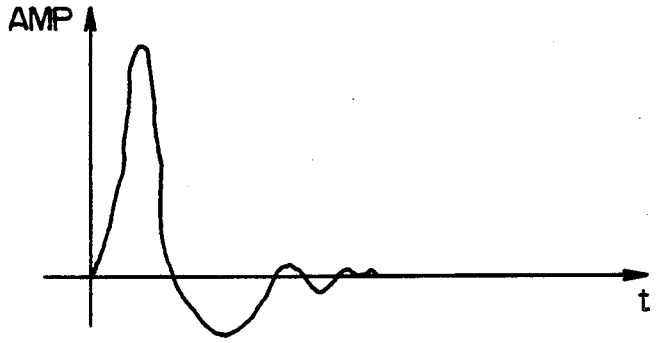
FIG. IC
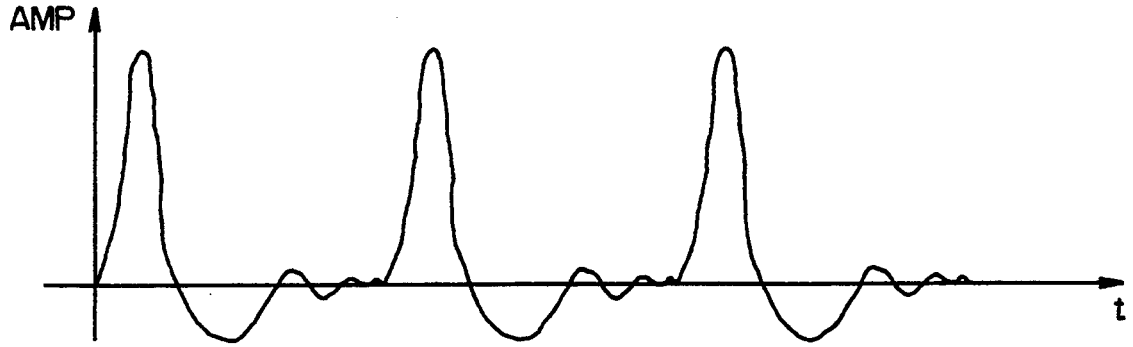
FIG. ID
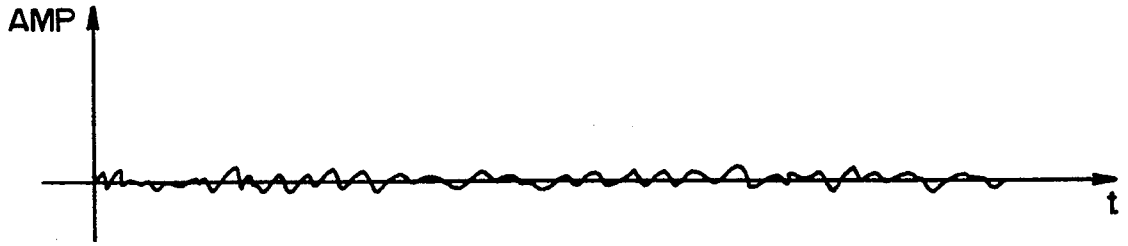

FIG. IE
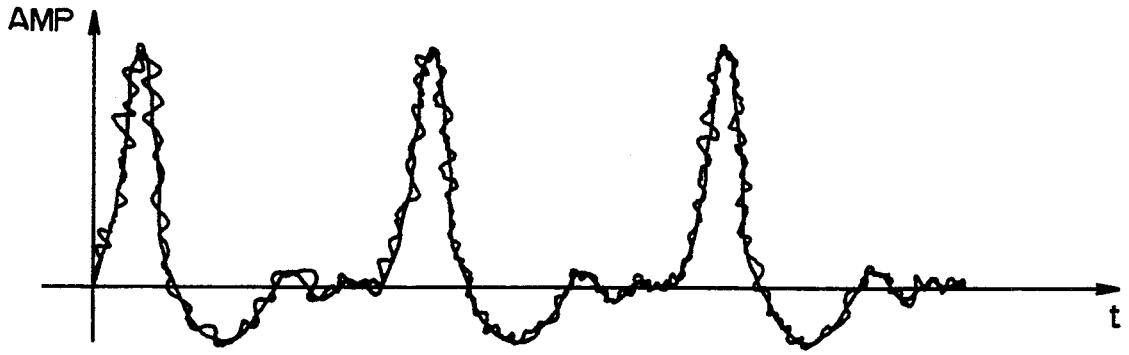
FIG. 4
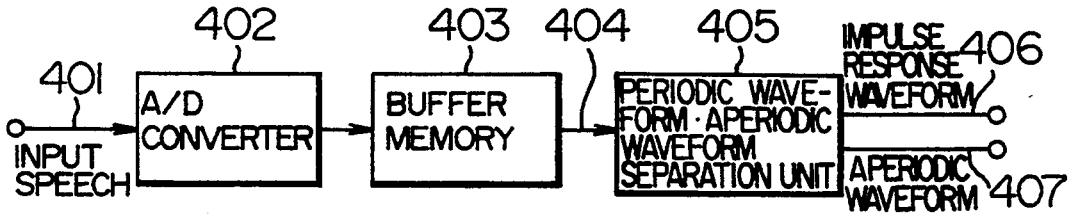

ORIGINAL WAVEFORM (INCLUDING THE WHOLE BAND COMPONENTS)

HIGH FREQUENCY WAVEFORM OF SYNTHESIZED SPEECH BY THE PRESENT INVENTION

HIGH FREQUENCY WAVEFORM OF SYNTHESIZED SPEECH BY ZERO PHASE SETTING METHOD

SPEECH SYNTHESIZER

BACKGROUND OF THE INVENTION

The present invention relates to a speech synthesizer and more particularly to a speech synthesizer which is suitable for obtaining a synthesized speech of high quality.

The basic construction of a speech synthesis system is, for example, described in detail in an article "PROCESSING OF DIGITAL SIGNAL OF SPEECH" by Rabiner (translated by Suzuki), April 1983, and in an article "DIGITAL PROCESSING OF VOICE" by Furui, The Tokai University Publishing Society, September, 1985.

In those articles, "a vocoder" is introduced as a kind of speech synthesizer. The vocoder serves to increase the information compressibility of the speech to perform the transmission and synthesis. In the vocoder, the spectrum envelop is obtained from the speech and the speech to be reconstructed is synthesized on the basis of the spectrum envelop. The various kinds of vocoders have heretofore been developed in order to improve the sound quality. In this connection, as the typical ones, there are given the channel vocoder and homomorphic vocoder.

In the systems employing those vocoders, however, since the accuracy of extracting the spectrum envelop information is insufficient, the quality of the synthesized speech is questionable. On the other hand, as a new method of extracting the spectrum envelop information, there is recently proposed a PSE (Power Spectrum Envelop) method. This method is a method wherein the Fourier power spectrum of speech is sampled with a pitch frequency. It is considered that the synthesized speech obtained by this method has a high quality, as compared with the prior art system. The details thereof can be referred to an article "POWER SPECTRUM ENVELOP (PSE) SPEECH ANALYSIS/SYNTHESIS SYSTEM" by Nakajima et al. (JOURNAL OF THE ACOUSTICAL SOCIETY OF JAPAN, Vol. 44, No. 11, 1988-11).

In the system of synthesizing speech using in the above-mentioned PSE analysis/synthesis method, in the same manner as in the homomorphic vocoder, the impulse response is subjected to the synthesized speech at intervals of pitch period. According to the above article by the Nakajima et al., the impulse response is obtained by setting the zero phase. This is based on the knowledge in which the acoustic sense characteristics of a human has the dull sensitivity to the phase. Moreover, according to the above article "PROCESSING OF DIGITAL SIGNAL OF SPEECH" by Rabiner, in addition to the zero phase, the minimum phase and the maximum phase are set to obtain the impulse response, and the qualities of individual synthesized speech are compared with one another. As a result, it is concluded that the best quality of synthesized speech can be obtained by the minimum phase method.

SUMMARY OF THE INVENTION

However, it is found from the examination by the present inventor that a random phase component is included in the high frequency component of the waveform of the natural speech and the random phase component performs an important part in natural sounding speech. However, in the above method, since the waveform of the random phase component is converted into the waveform having a uniform phase, the natural speech does not exist in the synthesized speech. Moreover, the same fact is also recognized in reconstructed sounds of the musical instruments.

The present invention was made in the light of the above circumstances, and an object thereof is to provide a speech synthesizer which is designed in such a way that the synthesized speech/sound of high quality is stably obtained.

In an aspect of the present invention, there are provided with a speech synthesizer for reading out a partial waveform of sound previously stored to subject the partial waveform to overlap addition every period to produce speech, according to the present invention, to provide a unit for storing a periodic waveform of sound, a unit for storing an aperiodic waveform of sound, and a unit for synchronistically adding the periodic waveform and the aperiodic waveform to each other.

In the light of that the setting of the uniform phase causes the degradation of the quality of synthesized speech to disable the production of the random component of the high frequency waveform from being realized, the speech synthesizer according to the present invention is designed as to be capable of producing the random component of high frequency.

More specifically, in the speech synthesizer according to the present invention, the waveform of the periodic component (impulse response) and that of the aperiodic component are individually stored. With respect to the waveform of the periodic component, the waveform of the impulse response is subjected to the overlap addition at intervals of the specified period, i.e., the waveform of the impulse response is shifted to be added every predetermined period and the waveform of the aperiodic component is added to the periodic component thereby to obtain the waveform of the natural speech in which the waveform of the random component is superimposed.

Next, the description will be given to the method of obtaining the waveform of the periodic component and that of the aperiodic component. The aperiodic component is included in the components of high frequency (e.g., 2 KHz or more). Therefore, the result of the output of the low pass filter of the original speech is used to extract the waveform of the periodic component, while the result of the output of the high pass filter is used to extract the waveform of the aperiodic component. With respect to the method of obtaining the waveform of the periodic component (impulse response), the details thereof are described in the above article "POWER SPECTRUM ENVELOPE SPEECH ANALYSIS/-SYNTHESIS SYSTEM" by Nakajima et al. That is, the waveform of the periodic component is extracted by multiplying the speech by the time window (e.g., the hamming window) every update period of the data (e.g., 10 ms). The waveform of the aperiodic component is extracted by multiplying the speech by the time window (rectangular window) of which length is the same as the update period every update period which is the same as that of the extraction of the waveform of the periodic component. Thus, conventionally, the aperiodic component of the waveform is processed as if it is a periodic component, causing deterioration of the audio quantity. On the other hand, since the aperiodic component is previously separated from the audio signal, and added the aperiodic component to the periodic component of the waveform, so that the aperiodic component is not changed to the periodic component to obtain the reproduction of good listening feeling.

BRIEF DESCRIPTION OF THE DRAWINGS

FIG. 1B is a waveform chart showing one example of a waveform stored in an impulse response waveform storage unit shown in FIG. 1A;

FIG. 1C is a waveform chart showing one example of a waveform which was subjected to the overlap addition in an overlap addition unit shown in FIG. 1A;

FIG. 1D is a waveform chart showing one example of a waveform stored in an aperiodic waveform storage unit shown in FIG. 1A;

FIG. 1E is a waveform chart showing one example of a waveform which was obtained by the addition in a simple addition unit shown in FIG. 1A;

FIG. 4 is a block diagram showing the arrangement of a periodic waveform-aperiodic waveform extraction unit;

DESCRIPTION OF THE PREFERRED EMBODIMENTS

The preferred embodiments of the present invention will hereinafter be described in detail with reference to the accompanying drawings. Incidentally, with respect to the speech synthesis, there are well known two methods, i.e., the synthesis by analysis and the synthesis by rule.

Figure 1A:
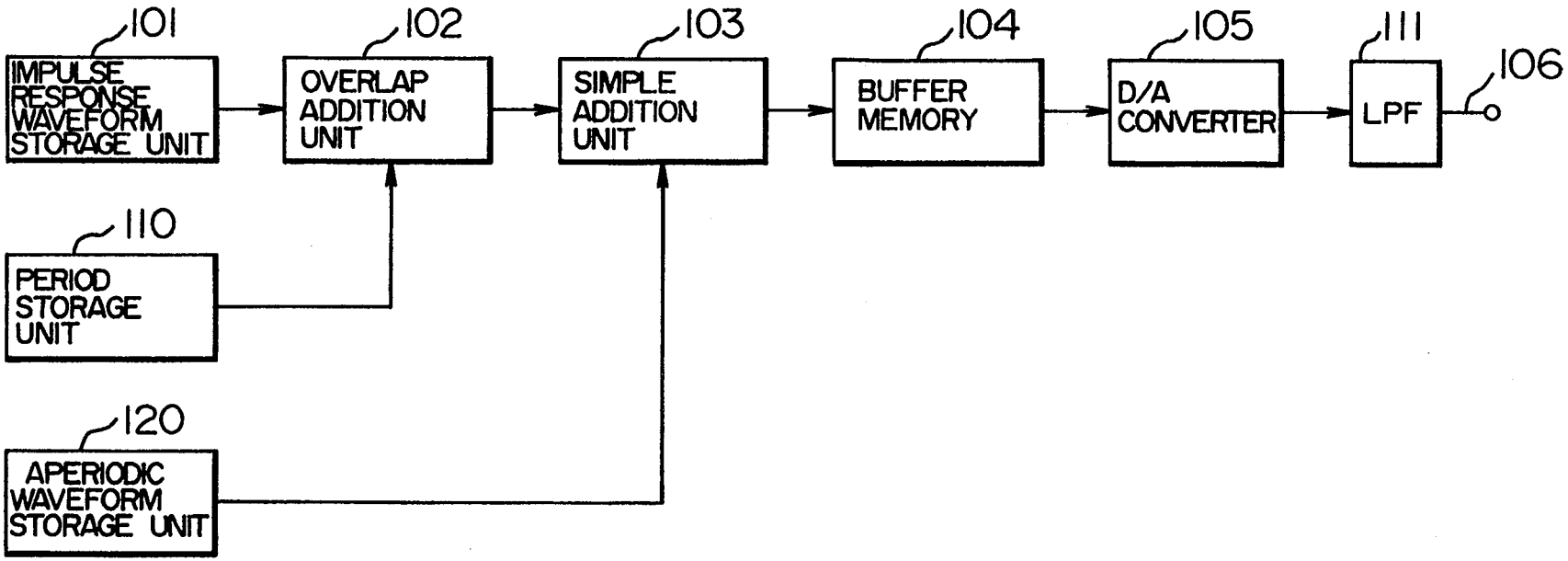
FIG. 1A is a block diagram showing the arrangement of one embodiment of a speech analysis/synthesis system of the present invention.

FIG. 1A is a block diagram showing the arrangement of a speech synthesis system of one embodiment of the present invention on the basis of the synthesis by analysis. In FIG. 1A, the reference numeral 101 designates an impulse response waveform storage unit; the reference numeral 102 designates an overlap addition unit which subjects the waveform of the impulse response to the overlap addition at periodic intervals; the reference numeral 103 designates a simple addition unit for adding the waveform obtained by the overlap addition and the aperiodic waveform to each other; the reference numeral 104, a double buffer memory for outputting speech; and 105, a digital-to-analog (D/A) converter. Moreover, the reference numeral 110 designates a period storage unit and the reference numeral 120 designates a periodic waveform storage unit.

The operation of the speech synthesis system thus constructed is as follows. First, in the impulse response waveform storage unit 101, the waveform data is stored which was obtained in such a way that as shown in FIG. 1B, the periodic waveform of sound was sampled in the direction of time to be quantized in the direction of the amplitude. The data representing a predetermined periodic interval of sound is stored in the period storage unit 110. In the overlap addition unit 102, the waveform data which was read out from the impulse response waveform storage unit 101 is subjected to the overlap addition at periodic intervals which were read out from the period storage unit 110. That is, the waveform data is shifted to be added every period interval read out from the period storage unit 110. The resultant waveform data is shown in FIG. 1C. The periodic interval stored in the period storage unit 110 corresponds to the peak-to-peak of the waveform data shown in FIG. 1C. In the simple addition unit 103, the waveform which was obtained by the overlap addition is added to the aperiodic waveform data which was read out from the aperiodic waveform storage unit 120. The aperiodic waveform data is, for example, random waveform data as shown in FIG. 1D. The waveform data which was obtained by the addition in the simple addition unit 103 has a waveform in which the waveform data of FIG. 1D is superimposed on the waveform data of FIG. 1C, as shown in FIG. 1E. That waveform data is converted into an analog waveform by the A/D converter 105 through the double buffer memory 104 for the speech output and then passed through the low pass filter 111 to be outputted in the form of speech 106.

Figure 2:
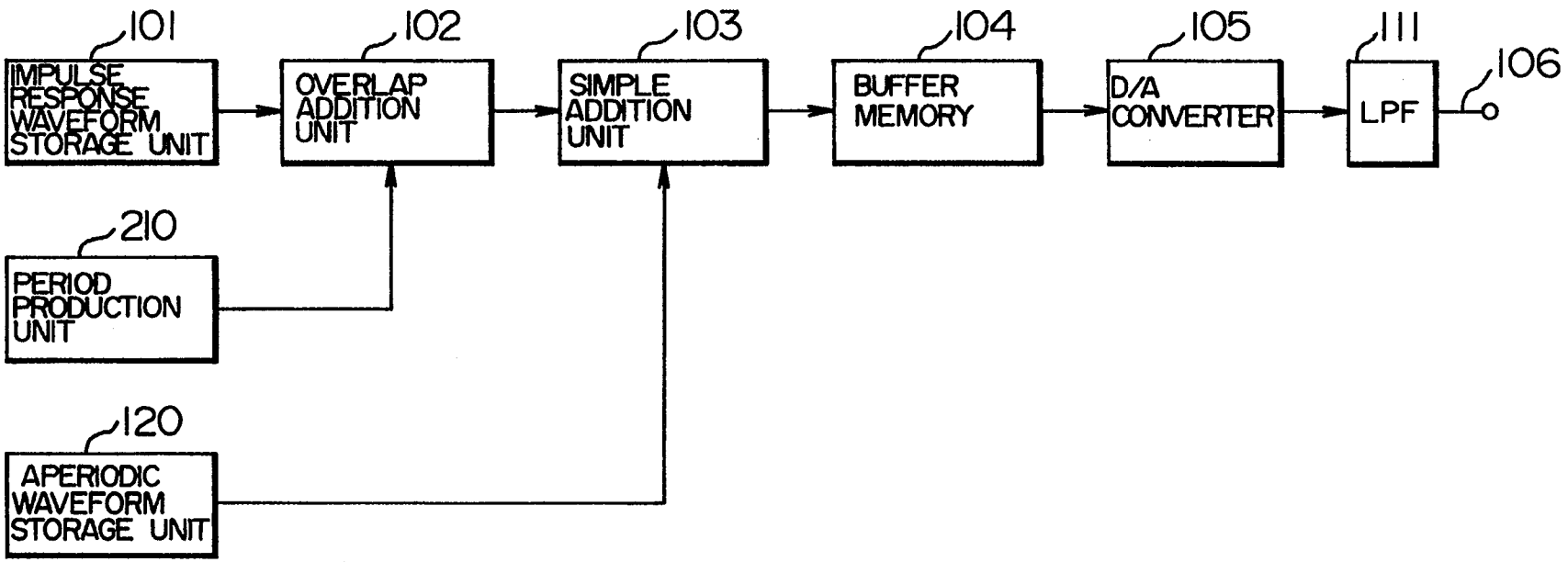
FIG. 2 is a block diagram showing the arrangement of one embodiment of a speech synthesis system by rule of the present invention.

FIG. 2 is a block diagram showing the arrangement of a speech synthesis system 1 of one embodiment of the present invention on the basis of the method of the speech synthesis by rule. In FIG. 2, the reference numeral 210 designates a period production unit for producing a periodic interval. The periodic interval corresponds to the peak-to-peak of the waveform data shown in FIG. 1B. The reference numerals other than the reference numeral 210 are the same as those of FIG. 1. The operation of the speech synthesis system 1 thus constructed of the present embodiment is as follows. In the overlap addition unit 102, the overlap addition of the impulse response waveform data is performed at periodic intervals obtained in the period production unit 210. The subsequent operations are the same as those of the example of the operation of the above speech synthesis system. In the period production unit 210, there are employed the method of adding or subtracting a certain constant value to or from the period for the purpose of performing the change of the pitch period of a predetermined speech sound (pitch shift), the Fujisaki model which was devised for the purpose of being applied to the speech synthesis system by rule, and the like. The method of producing a period by the Fujisaki model is, for example, described in JP-A-64-28695 and will be readily realized to those skilled in the art.

Figure 3:
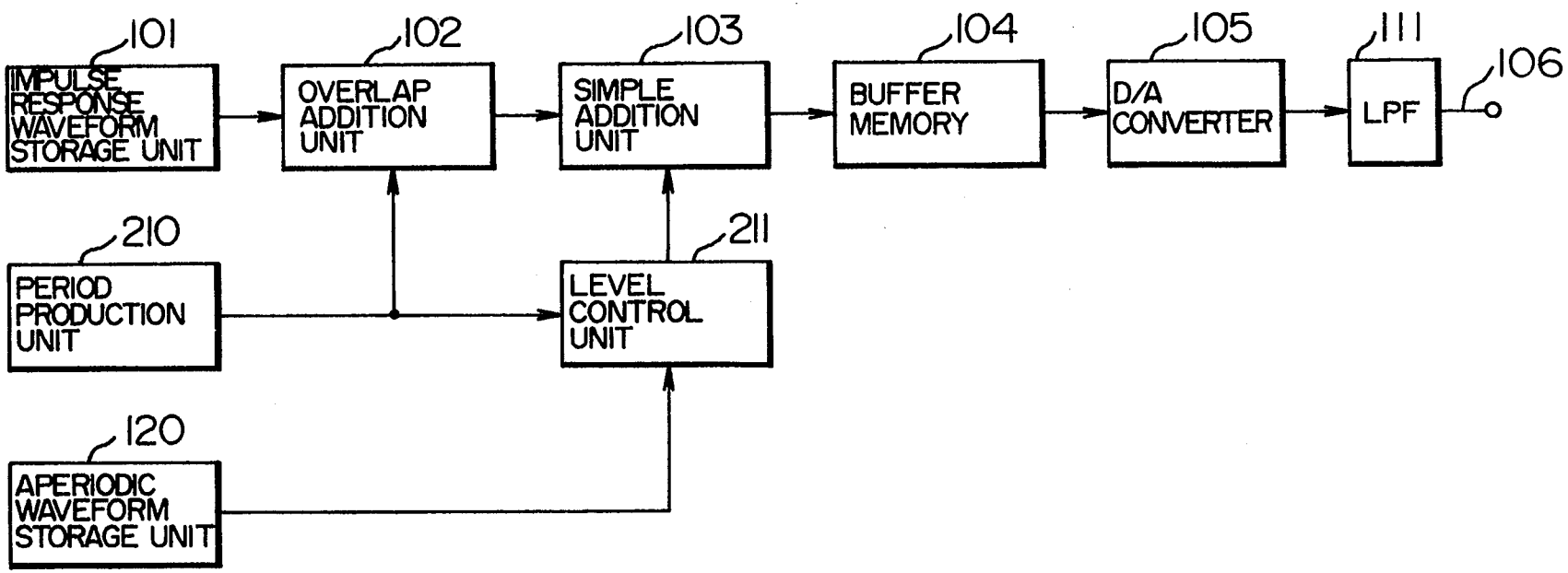
FIG. 3 is a block diagram showing the arrangement of another embodiment of the speech synthesis system by rule of the present invention.

FIG. 3 is a block diagram showing the arrangement of a speech synthesis system 2 of another embodiment of the present invention on the basis of the method of the speech synthesis by rule. In the speech synthesis by rule, it is the important theme to make the quality of synthesized speech approach that of natural voice as much as possible. As the result of the preliminary study relating to this respect by the present inventor, there is observed a tendency in which in the natural voice, the level ratio of the periodic waveform to the aperiodic waveform in the waveform of the natural voice is changed in correspondence to the position of the sentence speech. One tendency of the change of the ratio is such that if the pitch period becomes long in the end of a sentence for example, the level ratio of the aperiodic waveform is increased. In the speech synthesis system by rule in which the characteristics of the natural voice waveform are reflected, the resultant synthesized speech approaches the natural voice so that the quality of synthesized speech is enhanced. This is the outline of the speech synthesis system by rule 2.

In FIG. 3, the reference numeral 211 designates a level control unit for controlling the peak-to-peak of the aperiodic waveform data. The reference numerals other than the reference numeral 211 are the same as those of FIG. 2. The operation of the speech synthesis system by rule 2 thus constructed is as follows. In the level control unit 211, the level value (the peak value of the aperiodic waveform) which has the positive correlation to the value of the period produced by the period production unit 210 is obtained, and then, the periodic waveform data is multiplied by the level value. In other words, there is given the peak value of the waveform on which the waveform data shown in FIG. 1D is superimposed. The operations other than the above are the same as those of the example of the operation of the above-mentioned speech synthesis system.

FIG. 4 is a block diagram showing an example of the arrangement of a unit for extracting a periodic waveform and an aperiodic waveform. In FIG. 4, the reference numeral 401 designates an input speech signal which was obtained by subjecting the speech to the speech to electricity conversion through a microphone and the like, the reference numeral 402 designates an analog-to-digital (A/D) converter, and the reference numeral 403 designates a dual port buffer memory. This memory 403 is provided to prevent the discontinuation of the time adjustment of the following processing and the input speech. Moreover, the reference numeral 405 designates a unit for separating a periodic waveform and an aperiodic waveform from each other, the reference numeral 406 designates an impulse response waveform signal, and the reference numeral 407 designates an aperiodic waveform signal.

The outline of the operation of the periodic waveform-aperiodic waveform extraction unit thus constructed in this way is as follows.

The input speech signal 401 which was obtained by subjecting the speech into the speech to electricity conversion through a microphone and the like is inputted to the dual port buffer memory 403 through the A/D converter 402. The speech data 404 which was read out from the buffer memory 403 is inputted to the periodic waveform-aperiodic waveform separation unit 405 which separates the periodic waveform and the aperiodic waveform from each other to output individually the impulse response waveform signal 406 and the aperiodic waveform signal 407. In this connection, if instead of the impulse response waveform storage unit 101 and the aperiodic waveform storage unit 120 shown in FIG. 1, the periodic waveform-aperiodic waveform extraction unit shown in FIG. 4 is connected, it is possible to attain the speech synthesis of the input speech signal 401 which is being continuously inputted, instead of the stored waveform data.

Figure 5:
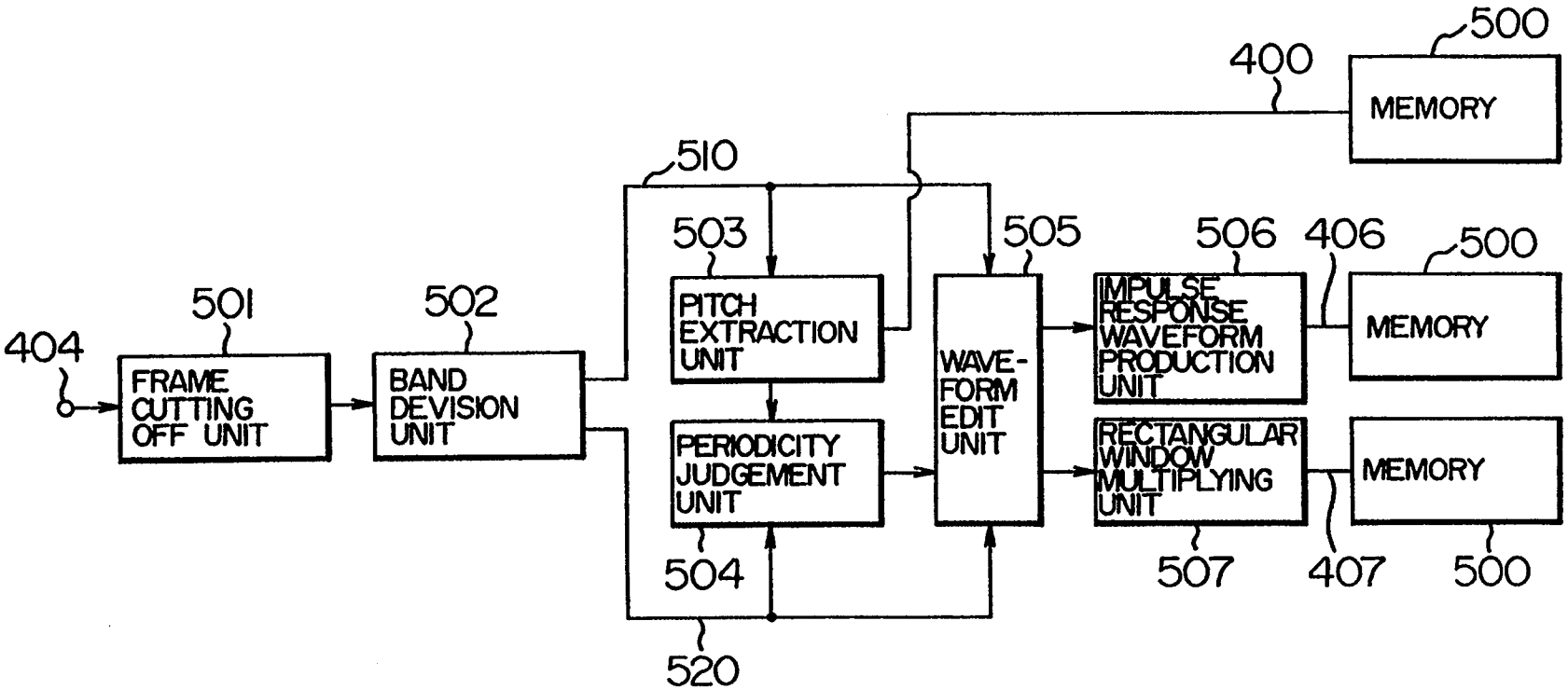
FIG. 5 is a block diagram showing the arrangement of a periodic waveform-aperiodic waveform separation unit.

FIG. 5 is a block diagram showing an example of the arrangement of the periodic waveform-aperiodic waveform separation unit 405. In FIG. 5, the reference numeral 404 designates the speech data which was read out from the dual port buffer memory 403 of FIG. 4, the reference numeral 501 designates a unit for cutting off a frame, the reference numeral 502 designates a band division unit for dividing the waveform data into two band of a low frequency and a high frequency, the reference numeral 510 designates the resultant waveform of low frequency, and the reference numeral 520 designates the resultant waveform of high frequency. Moreover, the reference numeral 503 designates a pitch extraction unit for obtaining a pitch period from the waveform of low frequency, the reference numeral 504 designates a periodicity judgement unit for judging the periodicity of the waveform of high frequency, the reference numeral 505 designates a waveform edit unit for performing the waveform edit in correspondence to the result of judgement of the periodicity, the reference numeral 506 designates an impulse response waveform production unit for obtaining an impulse response waveform data from the periodic waveform, and the reference numeral 507 designates a rectangular window multiplying unit for cutting off or out the aperiodic waveform in the frame interval.

The outline of the operation of the periodic waveform-aperiodic waveform separation unit thus constructed in this way is as follows.

When the speech data 404 is inputted, the waveform data having a fixed time length is obtained every frame period in the frame cutting off unit 501. The band division unit 502 divides that waveform data into two bands of a low frequency and a high frequency to output the waveform data of low frequency 510 and the waveform data of high frequency 520. The pitch extraction unit 503 obtains the pitch period from the waveform data of low frequency 510. This reason is that the periodicity of the low frequency waveform is stable. In the case of the speech synthesis by rule, for the purpose of improving the quality of synthesized speech, the pitch period may be stored in a non-volatile memory 500. In the periodicity judgement unit 504, when the waveform data of high frequency 520 is inputted, the correlation value between the pitch period lengths of the adjacent periodic waveforms obtained in the pitch extraction unit 503 is obtained to judge the periodicity of the high frequency waveform depending on the magnitude of the correlation value. If the correlation value is large, the periodicity is present, while if the correlation value is small, the periodicity is absent. In the waveform edit unit 505, the waveform edit is performed in correspondence to the result of judgement of the periodicity. In the waveform edit unit 505, when the periodicity is present, the waveform data which was obtained by adding the waveform data of low frequency 510 and the waveform data of high frequency 520 to each other is outputted as the periodic waveform data. At this time, the waveform data which has the value "0" over the whole intervals is outputted as the aperiodic waveform data. On the other hand, when the periodicity is absent, the low frequency waveform data 510 is outputted as the periodic waveform data, while the high frequency waveform data 520 is outputted as the aperiodic waveform data. When the periodic waveform data is inputted, the impulse response waveform production unit 506 obtains the impulse response waveform data 406. In this connection, the impulse response waveform data 406 is obtained in such a way that the periodic waveform is subjected to the Fourier transform, the spectrum envelop is obtained from the resultant spectra, and the inverse Fourier transform of the spectrum envelop is performed. Moreover, when the aperiodic waveform data is inputted, the rectangular window multiplying unit 507 obtains the aperiodic waveform data corresponding to the frame interval thereby to obtain aperiodic waveform data 407 having the frame period length. In the case of the speech synthesis by rule, the impulse response waveform data 406 and the aperiodic waveform data 407 may be stored in respective non-volatile memorys 500.

As described above, the impulse response waveform storage unit 101, the aperiodic waveform storage unit 120 and the periodic storage unit 110 which are shown in FIG. 1A, FIG. 2 and FIG. 3 are replaced with those non-volatile memorys 500.

The description will hereinbelow be given to the details of the operation of the periodic waveform-aperiodic waveform separation unit. There are well known some methods of realizing the band division unit 502. One of them is a method wherein the low pas filter is prepared, the output which was obtained by inputting the speech data 404 to that filter is used as the waveform data of low frequency, and the data which was obtained by subtracting the low frequency waveform data from the speech data 404 is used as the high frequency waveform data. More details about the design of the digital filter such as a low pass filter, is described in the article "PROCESSING OF DIGITAL SIGNAL OF SPEECH" by Rabiner (translated by Suzuki). It is to be understood that even if the high pass filter is prepared, it is possible to perform the same separation processing. Moreover, the method depending on no digital filter requires the Fourier transform processing.

In this method, if the numeric values of the frequency components which were obtained by the Fourier transform and of which frequency is more than or equal to a predetermined frequency are set to zero, and then the inverse Fourier transform is performed, the low frequency waveform data is obtained. As the high speed carrying out method, there is well known the fast Fourier transform (commonly known by FFT). Then, it is proper that the separation frequency between the high frequency and the low frequency (i.e., the cut off frequency of the low pass filter) is set to 2 to 3 KHz.

Moreover, the method of obtaining the pitch period is described in detail in the above article.

By the correlation value which is calculated in the periodicity judgement unit 504, it means the autocorrelation coefficient which is delayed by the pitch period. This calculation expression is expressed by the following equation;

$$\phi = \frac{\sum_{i=-T_{P/2}}^{T_{P/2}} W(i) \cdot W(i + Tp)}{\sqrt{\sum_{i=-T_{P/2}}^{T_{P/2}} W^2(i) \cdot \sum_{i=-T_{P/2}}^{T_{P/2}} W^2(i + Tp)}} \qquad \text{expression (1)}$$

where $\phi$ represents the autocorrelation coefficient, Tp represents the pitch period, and W(i) represents the waveform data at the time of i (peak value). W(0) means the waveform data which is at the center of the waveform cut off every frame period. The autocorrelation coefficient $\phi$ takes the values in the range of $-1$ to $+1$. When the autocorrelation coefficient $\phi$ takes a value near 1, the waveform is judged to be periodic. When the autocorrelation coefficient $\phi$ takes a value less than 0.7 to 0.5, the waveform may be judged to be aperiodic.

Moreover, the method of obtaining the impulse response waveform data from the periodic waveform data is stated in detail in the description about the homomorphic vocoder in the article "PROCESSING OF DIGITAL SIGNAL OF SPEECH" by Rabiner (translated by Suzuki).

The speech analysis/synthesis system can be realized in such a way that the one period waveform data 406 and the aperiodic waveform data 407 which were obtained in the periodic waveform-aperiodic waveform extraction unit described on referring to FIG. 4, and the pitch period 400 which was described on referring to FIG. 5 are recorded in the analysis synthesis system (FIG. 1A), the impulse response waveform storage unit 101 and the aperiodic waveform storage unit 120 of the speech synthesis system by rule (FIG. 2 and FIG. 3), and the periodic storage unit 110, respectively. Especially, when the time lag is absent between the speech analysis processing and the speech synthesis processing, as shown in FIG. 1A, FIG. 2 and FIG. 3, the speech synthesis function can be realized in such a way that the waveform data is directly inputted to the overlap addition unit 102 and the simple addition unit 103 without preparing the impulse response waveform storage unit 101, the aperiodic waveform storage unit 120 and the period storage unit 110.

Figure 6A:
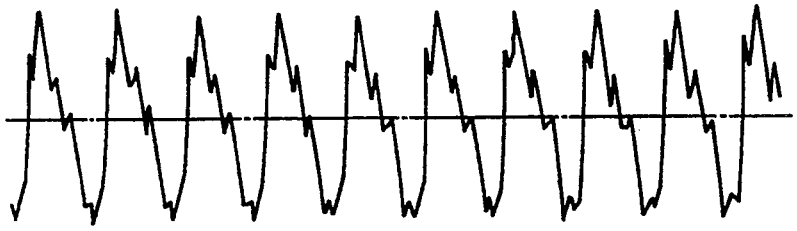
FIG. 6A is a waveform chart showing one example of an input speech waveform signal.
Figure 6B:
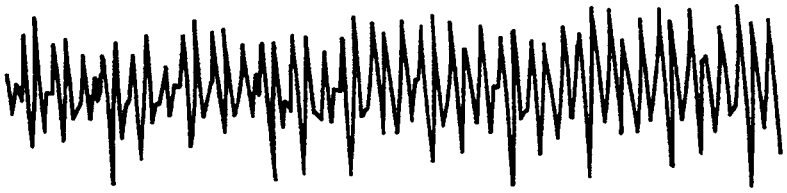
FIG. 6B is a waveform chart showing an aperiodic waveform of high frequency of a synthesized speed by the present invention.
Figure 6C:
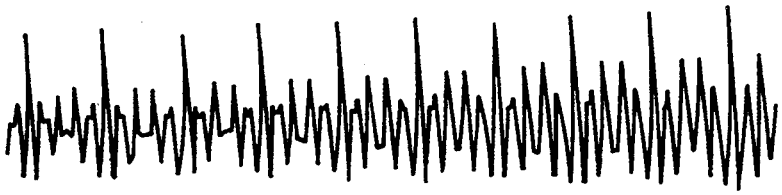
FIG. 6C is a waveform chart showing an aperiodic waveform of high frequency of a synthesized speed by the prior art zero phase setting method.

FIG. 6A to FIG. 6C are respectively waveform charts which were obtained from the experiment. Out of them, FIG. 6A shows a waveform of the input speech signal 401 which is shown in FIG. 4 and includes the whole band components. FIG. 6B shows the aperiodic waveform stored in the aperiodic waveform storage unit 120 shown in FIG. 1A, or the aperiodic waveform 407 shown in FIG. 4 and FIG. 5. That is, the aperiodic waveform 407 corresponds to the waveform data shown in FIG. 1D. Since that aperiodic waveform is the high frequency waveform of the synthesized speech by the present invention and faithfully reconstructs the aperiodic waveform component of the input speech signal 401 shown in FIG. 6A, the reconstructs speech gives good listening feeling, as compared with the high frequency waveform of the synthesized speech by the prior art zero phase setting method shown in FIG. 6C illustrating that the aperiodic component of the waveform is processed as if it is a periodic component. It is to be understood that this speech synthesis is not limited to the natural voice and it is similarly applicable to the sounds of the musical instruments, and the like.

What is claimed is:

1. A speech synthesizer for synthesizing speech by overlapping a partial speech waveform signal at predetermined periods, the speech synthesizer comprising:

a one-period waveform storage means for storing a one-period waveform signal component of a speech waveform signal;

an aperiodic waveform storage means for storing an aperiodic waveform signal having a component with a higher frequency than the one-period waveform signal component, the aperiodic waveform signal having a waveform different from the one-period waveform signal component;

an overlapping addition means for selectively repeating the one-period waveform signal component from the one-period waveform storage means with selected periods; and, a simple addition means for superimposing the aperiodic waveform signal from the aperiodic waveform storage means onto the one-period waveform signal component.

2. A speech synthesizer according to claim 1, further including a period storage unit for storing period data for indicating the selected periods of the one-period waveform signal components which are repeated by the overlapping addition means.

3. A speech synthesizer according to claim 1, further including a period production unit for generating the selected periods of one-period waveform signal components repeated by the overlapping addition means.

4. A speech synthesizer according to claim 3, the period production unit is connected to a level control unit for controlling peak values of the aperiodic waveform signal.

5. A speech synthesizer according to claim 4 wherein the level control unit controls the peak values such that the peak values have a positive correlation to the selected periods generated from the period production unit.

6. A speech synthesizer according to claim 1, further including:

an A-D converter for converting an analog speech waveform signal to a digital speech signal;

a buffer memory for storing the digital speech signal; and, a separation unit for dividing the digital speech signal into the one-period waveform signal components for storage in the one-period waveform storage means and the aperiodic waveform signal for storage in the aperiodic waveform means.

7. A speech synthesizer according to claim 6 wherein the separation unit includes:

a frame cut off unit for dividing the digital speech signal into frame signals;

a band division unit for dividing each frame signals into a low frequency waveform signal and a high frequency waveform signal;

a pitch extraction unit for obtaining a pitch period from the low frequency waveform signal;

a periodicity judgement unit for judging periodicity of the high frequency waveform signal;

a waveform edit unit for editing the frame signal to create the one-period waveform signal components and the aperiodic waveform signal in accordance with the judged periodicity of the high frequency waveform signal;

an impulse response waveform production unit for obtaining an impulse response waveform signal from the one-period waveform signals; and a rectangular window multiplying unit for obtaining a frame interval length aperiodic waveform signal from the aperiodic waveform signal.

8. A speech synthesizer according to claim 7 wherein the pitch extraction unit, the impulse response waveform production unit, and the rectangular window multiplying unit are connected to respective non-volatile memories, and the pitch period signal from the pitch extraction unit, the impulse response waveform signal from the impulse response waveform production unit and the aperiodic waveform signal from the rectangular window multiplying unit are stored in said non-volatile memories.

9. In a speech synthesizer in which a one-period waveform component of a synthetic speech signal is time delayed and added to a synthetic speech signal to create an unvoiced speech component and in which the one-period waveform component has adjustable periodicity to adjust pitch, THE IMPROVEMENT COMPRISING:

a means for superimposing an aperiodic waveform signal with a frequency higher than the one-period waveform on the one-period waveform to create more natural unvoiced speech; and a control means for controlling peak values of the aperiodic waveform signal and setting the peak values to have a positive correlation to a period of the one-period waveform component.

* * * * *